United States Patent [19]

Antle

[11] Patent Number: 4,499,593

[45] Date of Patent: Feb. 12, 1985

[54] MODULAR STEREO HEADPHONES

[76] Inventor: Gary W. Antle, 6 Atwood St., Kingston, Mass. 02364

[21] Appl. No.: 516,745

[22] Filed: Jul. 25, 1983

[51] Int. Cl.[3] ..... H04R 5/00

[52] U.S. Cl. ..... 381/25; 179/156 R

[58] Field of Search ..... 381/25; 179/156 R, 156 A, 179/178; 339/182 R, 183, 176 M, 91 R, 154 R, 154 A

[56] References Cited

U.S. PATENT DOCUMENTS

| | | | |
|---|---|---|---|
| 1,714,377 | 5/1929 | Kiernan | 179/156 R |
| 2,394,374 | 2/1946 | Gilman | 179/156 R |
| 3,829,624 | 8/1974 | Goodin et al. | 179/156 R |
| 4,373,766 | 2/1983 | Johnston | 339/154 A X |
| 4,409,442 | 10/1983 | Kamimura | 179/156 R |

FOREIGN PATENT DOCUMENTS

| | | | |
|---|---|---|---|
| 2847351 | 5/1980 | Fed. Rep. of Germany | 179/156 R |

*Primary Examiner*—Gene Z. Rubinson
*Assistant Examiner*—W. J. Brady
*Attorney, Agent, or Firm*—Donald W. Meeker

[57] ABSTRACT

Replaceable snap-together wires, headphones, headband and plug comprise a modular stereo headphone apparatus. Sealed headphones are provided with walled receptacles to receive mating removable clips secured to the ends of connecting wires. Each clip is molded to the wire insulation and around the wire ends which protrude slightly beyond the clip. Each clip is provided with a protruding movable lever arm with an indent for mating with a protrusion inside a receptacle shaped to fit the clip. Wires from the sound system within each headphone protrude through each receptacle wall to mate in proper polarity with wires in the inserted clip. A flexible headband is provided along its length with either a groove or tabs to receive a headphone connecting wire removably secured to the headband. At each headband end a sleeve receives a protrusion from one headphone adjustably secured to the headband with a spring-loaded pin in the sleeve engaging notches in the headphone protrusion. A male plug for the sound system has an adapter with one or two receptacles for receiving one or two clip ended wires from one or two headphone sets.

8 Claims, 7 Drawing Figures

MODULAR STEREO HEADPHONES

BACKGROUND OF THE INVENTION

1. Technical Field

The present invention relates to personal listening systems worn by the user for hearing wire transmitted sound, and in particular to stereo headphones comprising completely modular components.

2. Background Art

Standard stereo headphones have a common and very serious defect as a class of acoustical accessories. Because of the flexibility of the headphones relative to the headband, invariably the wire which connects the two headphones across the headband will break or be disconnected from the headphones. Headphones receive a great deal of use, particularly those owned by sound recording studios, and this use results in the breaking of the wire between headphones. A new wire then has to be soldered to the headphones requiring dismantling of the set and usually loss of use for a considerable time while the headphones are sent out for repair.

Other parts of headphones are also very prone to breaking or disconnection; the wire from the headphones to the sound transmitting source being a prime example. Again, considerable usage and particularly usage by musicians or dancers who are moving to the music will cause the wire to break or become disconnected either from the headphones or the plug into the sound system, requiring a long period of down time while the headphones are repaired.

Some hearing aids have snap-on ear pieces and some listening equipment for use with dictation machines and switchboards have some detachable components for assembly in different combinations with mouth pieces and either one or two ear pieces, but these are tubular sound connections rather than wired sound connections so they do not address the wire-breaking problem.

Even some of the structural connections between the headphones and the headband in stereo headphones are merely rigid wire connections and are prone to breaking with any rigorous use common in today's music business.

DISCLOSURE OF INVENTION

The present invention solves the breakage problem in stereo headphones with an entirely modular parts system having all wire connections made by releasable clips which absorb the stress of pulling on the wires so that the electrical wire connection is not easily broken, and which clips also provide correct polarity automatically becuase of the shape of the clips and receptacles so that they are simple to install instantly without tools or training in electronics. Should the wire break it may be disconnected and discarded and instantly replaced by a new modular connecting wire between headphones or from the headphones to the sound system.

Providing the same stress-absorbing clip connection to the plug into the sound system prevents breakage normally associated with the wire disconnecting from the plug. In addition, an alternate embodiment provides a double receptacle on a plug to enable the use of two headphones with a single plug into the sound system. Again this wire from the plug to the headphones may be easily replaced without the need for tools or soldering instantly as soon as any breakage occurs to the wire itself.

By providing a completely modular headphone system, any of the parts may be instantly replaced by backup parts so that no time is lost for headphone repair and no tools are required to clip the parts together, including all of the following modular components: headband, right and left headphones, connecting wire between headphones, connecting wire from headphones to plug, plug connector and the plug to the sound system.

A rigid structural bar with notches extending from each headphone provides a secure and adjustable means for connecting the headphone into a sleeve in the end of the headband with a spring-loaded pin for releasably securing the headphone to the headband adjustably but with no danger of breakage of the connecting bar to the headband.

Clip-in connectors into enclosed receptacles in the headphones enable the use of completely sealed headphone units with no need to access the interior of the headphone as in standard headphones which require constant reconnection or replacement of the wires to the headphones. The sealed headphones last a great deal longer than non-sealed units which can become contaminated with dust and moisture inside the headphone.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
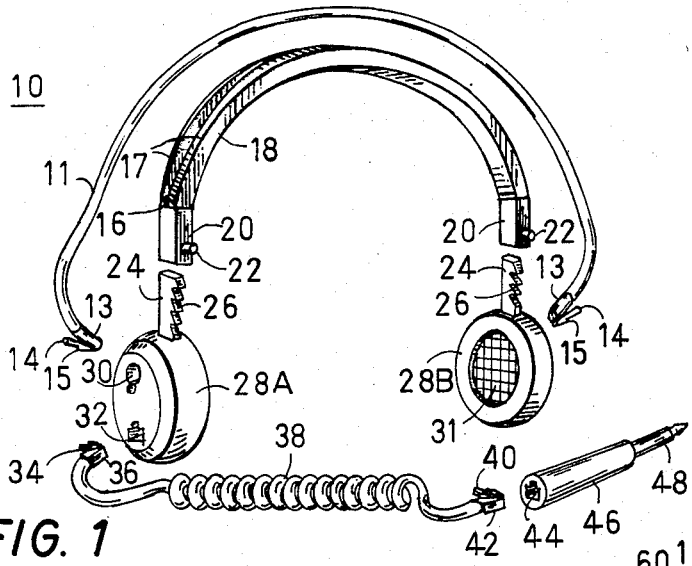
FIG. 1 is a perspective view of the modular components of the invention aligned for interconnection.
Figure 2:
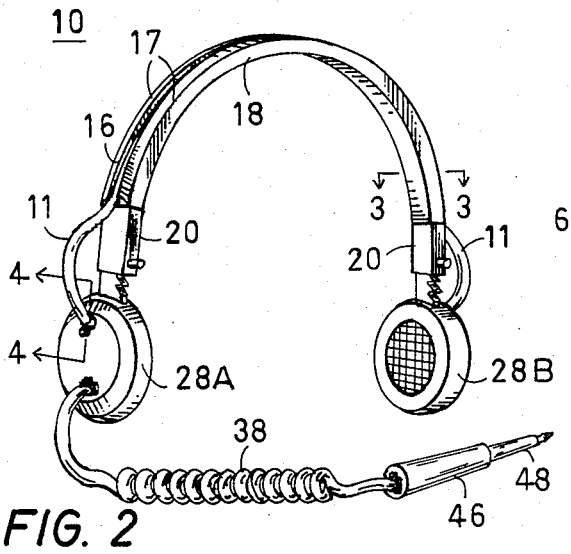
FIG. 2 is a perspective view of the invention completely assembled and ready for use.

In FIGS. 1 and 2 the modular components of the stereo headphones are shown, first separately to indicate each modular component and how the components are aligned, and then shown assembled for use. Each wire component is connected to the various other components by a removable clip 13, 36 and 42 which is molded around the wires contained therein and tightly secured to the insulation around the wires so that tension on any of the wires is absorbed by the clip as it is secured in a related component and the tension is not put on the wire connection itself, thereby serving to provide a very strong wire connection which is not likely to be pulled apart under normal usage. Each clip is shaped to fit into each receptacle opening (13 in 30, 36 in 32 and 42 in 44) so that correct polarity is maintained in the connection. A movable lever arm 14, 34, and 40 is eccentrically mounted on each clip and each receptacle for a clip only permits one orientation of the clip in the receptacle thereby insuring correct polarity of the wires contained within the clip. Molded or pressed plastic is preferred as a material for each clip to be formed into any desired shape (rectangular as in 36 and 42, round as in 13 or any other) around the wires properly aligned therein, and with a movable lever arm extending to one side for removably hooking into a receptacle. Each receptacle 30, 32 and 44 is formed in a matching shape to the appropriate clip.

Figure 4:
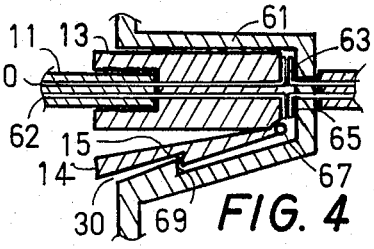
FIG. 4 is a cross-sectional view of a clip in a headphone receptacle taken through 4—4 of FIG. 2.

In FIG. 4 each receptacle is provided with an interior wall 61 having wires 63 and 65 protruding through the interior wall to align with the clip wires 60 and 62. Having a closed receptacle enables the headphone 28 to be a completely sealed unit with the wires 63 and 65 from the sound components inside the headphone wired out through the receptacle wall.

Figure 3:
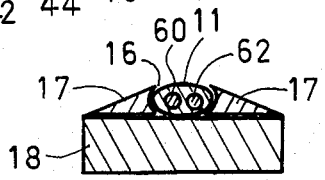
FIG. 3 is a cross-sectional view of the headband of the invention taken through 3—3 of FIG. 2.
Figure 7:
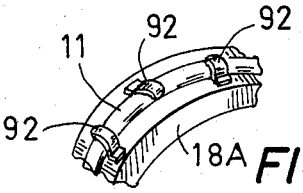
FIG. 7 is a partial perspective view of an alternate embodiment of the means for removably securing the connecting wire to the headband.

In FIGS. 1, 2 and 3 a headband 18 is formed of a flexible yet shape-retaining material into an arcuate shape to fit over the top of the head of the wearer. Along the length of the top surface of the headband a pair of opposing ridges 17 form an elongated groove 16 therebetween to receive and removably secure a connecting wire 11 in the groove. The ridges are a flexible rubberized material spaced apart a distance slightly smaller than the wire so that friction holds the wire in place for use, but the wire can be pulled out of the groove easily for replacement. In FIG. 7 an alternate embodiment of the connecting wire securing means provides a series of alternately facing elevated tabs 92 along the length of the top of the headband through which tabs the connecting wire 11 may be snaked to secure the wire removably under the tensioned tabs. Replacement of the connecting wire is easily accomplished by pulling the wire from the tabs and instantly replacing the wire with no tools required for either the groove or the tab system.

Additionally at each end of the headband, a hollow sleeve 20 is permanently secured. A spring-loaded pin 22 protrudes through the wall of each sleeve with an exterior visible button portion to push and an interior nonvisible point portion to engage notches 26 in an attaching bar 24 from a headphone. Each headphone 28 is equipped with a rigid bar 24 permanently secured to the headphone, which bar 24 fits slidably and removably within a sleeve 20 of the headband. Therein the pin 22 engages one of the notches 26 along one edge of the bar to secure the headphone at a desired length of insertion within the sleeve. The headphone may then be instantly adjusted or removed with no tools by simply pushing the button 22 and moving the headphone. Other adjustable means for securing the headphones to the headband may be substituted.

Each of the two headphones is a sealed unit encasing the electronics for transmiting sound through a speaker means 31. One of the headphones 28*a* is provided with two receptacles 30 and 32 for receiving matching clips 13 and 36. On the side of the headphone away from the speaker means the uppermost receptacle 30 is an opening shaped in a circular configuration with an eccentric extension of the opening to match the clip 13 from the connecting wire 11. A lower receptacle 32 is an opening shaped in a rectangular configuration with an eccentric extension of the opening to match a clip 36 from a second wire 38 to the sound source. Each receptacle is provided with interior walls to maintain the seal of the headphone with only the internal headphone wires from the sound components protruding through the walls. The second headphone 28*b* has only the single upper receptacle similar to the upper receptacle 30 of the first headphone for receiving one of the two clips 13 for the connecting wire 11.

The connecting wire 11 in FIGS. 1, 2, 3, and 4 is a double wire (one live 60 and one ground 62) housed within standard rubberized insulation. At each end of the wire a hardened plastic clip 13 is formed around the two wires. Eccentrically mounted on each clip a movable lever 14 is hinged to the exterior of the clip by a conventional metal hinge 67 or a "living plastic" hinge. An indent 15 on each lever hooks over a mating edge 69 within each matching receptacle 30 to retain the clip securely in place by snapping into the receptacle and remove instantly without tools by moving the lever arm toward the clip to unhook the indent from the mating edge in the receptacle. Each clip snaps removably into a matching walled receptacle 30 in one of the two headphones to interconnect the headphones for transmitting sound therebetween by matching internal wires 63 and 65 extending through the receptacle wall 61 from the sound components inside the sealed headphone.

The second wire 38 clips into the bottom receptacle 32 of the first headphone and connects through a male plug 46 to the sound producing system, which could be a sound recording transmitter, radio, musical instrument or any other sound transmitting source fitted with a standard outlet to receive a metal pronged 48 male plug 46. The second wire 38 contains two live sound transmitting wires and two ground wires housed within standard insulation. At one end the clip 36 with movable lever arm 34 is molded around the wires and secured to the wire insulation leaving the wire ends protruding to contact matching wires inside the lower headphone receptacle 32. At the other end of the second wire a similar clip 42 with movable lever arm 40 is molded around the wires. The male plug 46, at one end, is provided with the standard metal prong 48 for insertion in the sound producing system, and at the other end, is provided with a receptacle opening 44 shaped to receive the second clip 42 of the second wire to connect the sound source with the headphones. Matching wires within the plug receptacle 44 insure correct polarity.

Figure 6:
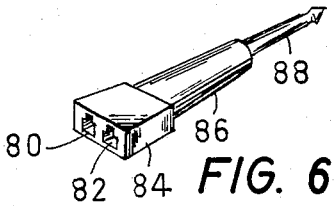
FIG. 6 is a perspective view of another alternate embodiment of the male plug for the sound system with a built-in adapter to receive two sets of headphones.
Figure 5:
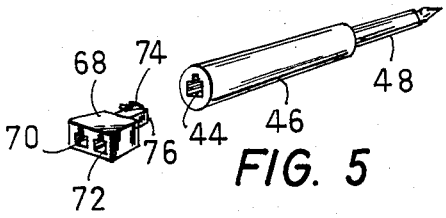
FIG. 5 is a perspective view of an alternate embodiment of the male plug to the sound system with an adapter for receiving two sets of headphones aligned for insertion into the plug.

In FIG. 5 an alternate embodiment provides an additional adapter 68 with a clip 74 on one side for insertion in the male plug receptacle 44 and, on the other side, with a pair of receptacles 70 and 72 for receiving wire clip connections from two sets of headphones. In FIG. 6 another alternate embodiment 86 of the male plug is provided with a built-in adapter 84 with a pair of receptacles 80 and 82 to receive wire clip connections from two sets of headphones.

The entire modular system plugs together instantly with no tools for a complete sturdy stereo headphone set. Any components which do become defective may be instantly removed from the system with no tools and instantly replaced by identical modular component parts so that there is no time lost for expensive and typically long repairs.

It is understood that the preceding is given merely by way of illustration and not in limitation of the invention and that various modifications may be made thereto without departing from the spirit of the invention as claimed.

I claim:

1. A modular stero headphone apparatus comprising:

a tensioned headband comprising an arcuate member to fit over the top of a wearer's head provided along the length of the headband with a means for removably receiving a length of wire, and at each end of the headband a means for adjustably and removably receiving a headphone;

a headphone adjustably and removably attached to each end of the headband, a first of which headphones is provided with a first receptacle shaped for removably receiving a polarity correct clip wired to a sound transmitting source and a second receptacle shaped for removably receiving a polarity correct clip wired to a second headphone, which second headphone is provided with a single receptacle for removably receiving a polarity correct clip wired to the first headphone and each headphone is provided with a protrusion to fit adjustably and removably into an end of the headband;

a first wire component comprising a signal transmitting conducting wire for each of the two headphones and two grounding wires all within an insulating covering, and at a first end of the first wire component a polarity correct clip which plugs removably into a male connector plug to a sound transmitting source, and at a second end of the first wire component a polarity correct clip which plugs removably into the first receptacle of the first headphone;

a second wire component removably secured to the headband, which second wire component comprises a single signal transmitting conducting wire and a single ground wire within an insulating covering, and at a first end of the second wire component a polarity correct clip which plugs removably into the second receptacle of the first headphone and at a second end of the second wire component a polarity correct clip which plugs removably into the receptacle in the second headphone;

wherein each polarity correct clip comprises a molded body enclosing wires exposed at an end face of the clip and extending eccentrically from the clip body a movable latching means, and each receptacle is provided with a matching removably interlocking latch and each receptacle is provided with wires from sound components to contact the matching clip wires and each receptacle is shaped to receive each clip in only one orientation thereby assuring correct polarity, and wherein each clip is secured to the insulation so that the clip absorbs any tension put on the wire component and the wire contacts are not stressed.

2. The apparatus of claim 1 wherein the headband further comprises an elongated pair of spaced ridges along the top of the headband which ridges removably secure the second wire component therebetween by a tight friction fit.

3. The apparatus of claim 1 wherein the male connector plug comprises a plug body housing connecting wires and, on one side of the plug body, a protruding metal male connector shaft for insertion into a female receiving opening in the sound transmitting source and, on the other side of the plug body, a receptacle shaped to receive removably a polarity correct clip therein for making an electrical connection between the male connector plug and the clip.

4. The apparatus of claim 3 further comprising between the male connector plug and the clip at the first end of the first wire component a multiple clip adapter for two clips comprising a removable polarity correct clip, on one side of the adapter, for insertion into the receptacle in the male connector plug and, on the other side of the adapter, two receptacles each shaped for removably receiving a polarity correct clip thereby servicing two sets of headphone apparatus.

5. The apparatus of claim 1 wherein the male connector plug comprises a plug body housing connecting wires and, on one side of the plug body, a protruding metal male connector shaft for insertion into a female receiving opening in the sound transmitting source and, on the other side of the plug body, two spaced apart receptacles each for removably receiving a polarity correct clip therein for making an electrical connection between the male connector plug and the clip, thereby servicing two sets of headphone apparatus.

6. The apparatus of claim 1 wherein the headband means for adjustably and removably receiving a headphone comprises a sleeve at an end of the headband, which sleeve is pierced by a spring-loaded pin removably penetrating the sleeve and the headphone protrusion comprises a rigid bar secured to the headphone and extending therefrom, which bar is provided along an edge with spaced notches and which bar fits slidably within the sleeve with the pin contacting the notches to control the amount of advancement of the bar within the sleeve.

7. The apparatus of claim 1 wherein each headphone comprises a sealed body with the receptacles walled interiorly to maintain the seal so that only the wires from the sound components within the headphone protrude through the receptacle walls to contact the aligned wires in the clip.

8. The apparatus of claim 1 wherein the headband means for removably securing the second wire component comprises alternately facing tabs spaced along the length of the headband for removably engaging the second wire component snaked through the series of tabs.

* * * * *